US005868392A

United States Patent [19]

Kraft

[11] Patent Number: 5,868,392

[45] Date of Patent: Feb. 9, 1999

[54] METHOD AND APPARATUS FOR PLAYING A POKER GAME WITH A UNIQUE BETTING FORMAT

[75] Inventor: Lee D. Kraft, Chandler, Ariz.

[73] Assignee: Kraft Gaming & Golf Inc., Chandler, Ariz.

[21] Appl. No.: 976,883

[22] Filed: Nov. 24, 1997

[51] Int. Cl.[6] ..... A63F 1/00

[52] U.S. Cl. ..... 273/292

[58] Field of Search ..... 273/292, 274, 273/303, 305

[56] References Cited

U.S. PATENT DOCUMENTS

| | | | |
|---|---|---|---|
| 5,072,946 | 12/1991 | Miller | 273/292 |
| 5,257,810 | 11/1993 | Schorr et al. | 273/292 |
| 5,288,077 | 2/1994 | Jones | 273/292 |
| 5,377,973 | 1/1995 | Jones et al. | 273/85 CP |
| 5,382,025 | 1/1995 | Sklansky et al. | 273/292 |
| 5,390,934 | 2/1995 | Grassa | 273/292 |
| 5,395,120 | 3/1995 | Malek | 273/292 |
| 5,486,005 | 1/1996 | Neal | 273/292 |
| 5,489,101 | 2/1996 | Moody | 273/292 |
| 5,494,296 | 2/1996 | Grassa | 273/292 |
| 5,531,448 | 7/1996 | Moody | 273/292 |
| 5,544,892 | 8/1996 | Breeding | 273/292 |
| 5,573,249 | 11/1996 | Johnson | 273/292 |
| 5,636,843 | 6/1997 | Roberts | 273/292 |
| 5,639,092 | 6/1997 | Macaisa | 273/292 |
| 5,649,705 | 7/1997 | String | 273/292 |
| 5,664,781 | 9/1997 | Feola | 273/292 |
| 5,700,010 | 12/1997 | Mimier | 273/292 |

*Primary Examiner*—William E. Stoll
*Attorney, Agent, or Firm*—Schmeiser, Olsen & Watts

[57] ABSTRACT

According to the present invention, a method and apparatus for playing a poker game with a unique betting format is disclosed. A card game played according to a preferred embodiment of the present invention is somewhat similar in spirit to traditional poker. However, using the present invention, the individual players can place a multitude of different types of bets that aren't normally associated with traditional poker. For instance, individual players can choose to bet on which hand will win, players can bet on which group of adjacent players' stations will contain the winning hand, players can bet on which combination of cards will win, and, finally, players can bet on certain specialty bets, such as betting that the winning hand will be at least three-of-a-kind comprising jacks or better.

28 Claims, 9 Drawing Sheets

112

320

One Card From a Hand Must Play & Beat Board Cards to Count--Push (Tie) if Not

321

Pays Only the Winning/ Highest Hand(s)

If One or More Hands Tie for Highest Hand--One/Half Rate Below Paid

| | |
|---|---|
| One Pair or Less | 4 to 1 |
| Two Pairs | 1 to 1 |
| Three of a Kind | 2 to 1 |
| Straight | 2 to 1 |
| Flush | 3 to 1 |
| Full House | 3 to 1 |
| Four of a Kind | 3 to 1 |
| Straight Flush | 40 to 1 |
| Royal Flush | 50 to 1 |

322

Best Hand Betting

Pays only the Highest Hand(s)

323

Even Money Bets

All Winning Bets Pay 1 to 1

If multiple hands tie for highest hand, only one winner will be paid!

FIG. 3

METHOD AND APPARATUS FOR PLAYING A POKER GAME WITH A UNIQUE BETTING FORMAT

BACKGROUND OF THE INVENTION

1. Technical Field

This invention generally relates to the field of gaming and more specifically relates to a method of playing cards.

2. Background Art

Five card and seven card poker are games that almost everyone knows how to play. As a leisure time activity, poker and other card games have fascinated the public for many years. A vast majority of the many developed poker variations use the same basic priority or ranking of winning poker hands (i.e., Royal Flush, Straight Flush, Four of a Kind, Full House, Flush, Straight, Three of a Kind, Two Pair, One Pair, and High Card(s) in a Hand). For various reasons, it has been difficult to adapt the game of poker into a casino table game in which each player wagers against the house.

In an informal "family type" poker game, each player is dealt a poker hand by the "dealer" who is usually one of the players at the table. Frequently, each player/dealer has the option to choose what type of game (i.e.—five card stud, five card draw, seven card stud, hi-low, Texas Hold 'Em) is played during the deal. This feature is called "dealer's choice." The player with the highest hand, based on the established priority of poker hands, wins that hand. After a player deals, the deal moves around the table in a clockwise fashion, ensuring that each player gets a turn as dealer. It is also common to introduce wagering into the game through the use of tokens or poker chips that usually, but not necessarily, have a monetary value.

Many locations, both within and without the United States, have legalized various forms of gambling. Poker is one of the most popular games of chance and is presently offered in most gaming establishments, such as casinos, that also offer craps, roulette, blackjack, slots, etc. and also in cardrooms which provide for card playing only. Indian casinos and riverboats generally also offer poker, and these venues may or may not offer craps, roulette, slots, etc.

In a conventional cardroom poker game played at a commercial gaming facility, the casino or "house" provides a dealer, the playing cards, the table, the chairs, and, most likely, the gaming chips. Although the house provides the dealer, the dealer is not dealt any cards, nor does the dealer place any wagers. Instead, the dealer shuffles and deals the cards, monitors the betting activity of the players, and controls the overall flow and pace of the game. As compensation, the house typically collects a nominal percentage of each player's bet (the "rake"), or a percentage of the total pot (usually capped). Alternatively, the house may charge each player a set fee per hand or a fee for playing a specified length of time. Given these conditions, house profit is limited to a specific amount per hand played.

While very popular, many people do not like to play cardroom poker because each player is competing against his fellow players. Many people would rather attempt to win money from an impersonal source, i.e., the house or the casino, rather than from their fellow players with whom they may be acquainted. In addition, the actual game play and betting strategy associated with poker can be very confusing and intimidating for many individuals. Additionally, during peak times, potential poker players may have to wait a long time before actually getting a seat as either all the tables may be full, and/or no new tables will be started until there are at least seven to ten new players. These factors prevent many people from participating in conventional cardroom poker games and tend to limit the involvement of many casino patrons who might otherwise be inclined to play poker.

Further, traditional cardroom or casino poker games limit the payout for the winning hand to the amount of money wagered (minus the rake taken by the house) by all of the players. In some cases, a player may have a very strong hand but not win a very big pot because all of the other players "fold" or quit. In addition, there is no opportunity to receive a bonus payment for a particularly good hand. For example, while a Royal Flush is a rare occurrence and generates a thrill for any poker player when they are dealt this hand, the player collects the same total wager that they would have collected if all they needed to beat the other players was a hand containing Two Pairs.

One popular conventional form of live table poker is known as "Texas Hold 'Em" or "Hold 'Em." In this variation, each player at the table is dealt two cards, face-down. These cards are known as the "hole" cards. After a round of betting, the dealer deals three face-up cards, known as the "flop." Another round of betting follows, after which the dealer deals a fourth face-up card, called the "turn" or "fourth street" card. After a third round of betting, the dealer deals a fifth and final face-up card, called the "river" or "fifth street" card. Then, a fourth (final) round of betting occurs. Whenever the dealer deals one or more cards, the dealer may "burn" one or more cards prior to the deal. The burn card or cards are placed in a special spot on the table. Burn cards play no part in the game and are merely a ritual devised to inhibit cheating. Players may fold at any time during the four rounds of betting.

After all cards are dealt and turned face-up, each player uses his or her hole cards in conjunction with any three, four, or all of the five common cards to fashion the best poker hand possible. The winning player is determined by the highest ranking poker hand, once again using standard poker rank as the criterion for comparison. The pot is then awarded to the winning player, or split among two or more winning players possessing hands of equal poker rank. In another variation, the game is played "high-low split," with the total pot being evenly divided between the player having the highest poker hand and the player having the lowest poker hand.

In traditional variations of Hold 'Em, the players compete against each other rather than against the house, and each player must either participate with the two cards dealt to them or fold their cards and wait for the next hand. If s often tedious and boring when playing Hold 'Em to continually get two low, unsuited cards and fold hand after hand for long periods. Also, there is no possibility in such known Hold 'Em poker variants for more than one player to select or possess the identical hand. Later variations of Hold 'Em try to minimize these deficiencies by allowing each player to select a single hand from one of a multiplicity of hands existing on the table. The selections are made before the final communal or non-communal cards are dealt and a winner can be tallied. However, if one or more of the hands are not chosen, they are "folded" and removed from play. Still, even with these improvements, traditional Hold 'Em poker games suffer from not having enough variation in betting choices.

DISCLOSURE OF INVENTION

According to a preferred embodiment of the present invention, a method and apparatus for playing a poker game with a unique betting format is disclosed. A card game played according to a preferred embodiment of the present invention is somewhat similar to traditional poker and, more specifically, to Hold 'Em poker.

The present invention requires only one person to play the game, doesn't allow any of the hands to fold, and doesn't require the players to physically touch the cards. Further, it introduces a wide variety of bets that aren't normally associated with poker as it allows each player to wager on one, many, or all of the hands dealt.

For example, the bettor could choose to bet on several or even all of the possibilities. The more possibilities the bettor chooses will increase—or even guarantee—the chance of winning, but perhaps to the bettor's overall financial disadvantage. As in many other games of chance, each bettor must choose between the coverage afforded a single wager (with a limited chance of winning) versus multiple wagers which correspondingly increase the chances of winning. This kind of strategy and challenge for the bettor is provided by various preferred embodiments of the present invention.

Aside from the advantage of having a multiplicity of bets from which a gambler can choose, the present invention is adaptable to a variety of familiar betting areas. For instance, betting areas based on craps, blackjack, or roulette can be fashioned in accordance with various preferred embodiments of the present invention. Accordingly, the learning time for gamblers who are new to the game is reduced, and casinos will have an easier time attracting new customers to the game. In addition, with the backline betting option, the number of gamblers participating in a given poker game can be very large.

Finally, another preferred embodiment of the invention provides the option (similar to roulette) of using colored chips or markers to clearly and distinctly mark each player's bets. This option allows easy pay-out, reduced error in payout and assures that each player is satisfying the casino rules (namely, minimum bets) for each round of play. In addition, the players are more likely to sit and play until they lose all of the money they started with because of the exchange process (players are less likely to exchange their favorite colored chips for regular casino chips). On average, typical casino table games retain less than twenty-five percent of the money a gambler brings to the table; the colored chips typically help to raise this percentage.

The foregoing and other features and advantages of the present invention will be apparent from the following more particular description of preferred embodiments of the invention, as illustrated in the accompanying drawings.

BRIEF DESCRIPTION OF DRAWINGS

The preferred embodiments of the present invention will hereinafter be described in conjunction with the appended drawings, wherein like designations denote like elements, and:

FIG. 3 is an enlarged plan view of a betting-rules area from FIG. 1;

BEST MODE FOR CARRYING OUT THE INVENTION

According to the present invention, a method and apparatus for playing a poker game with a unique betting format is disclosed. The unique betting format adapts itself very well to a variety of betting layouts. As such, several different betting layouts have been developed to make it easy to acclimate new users to the same game and to give casinos several options from which to choose.

Figure 1:
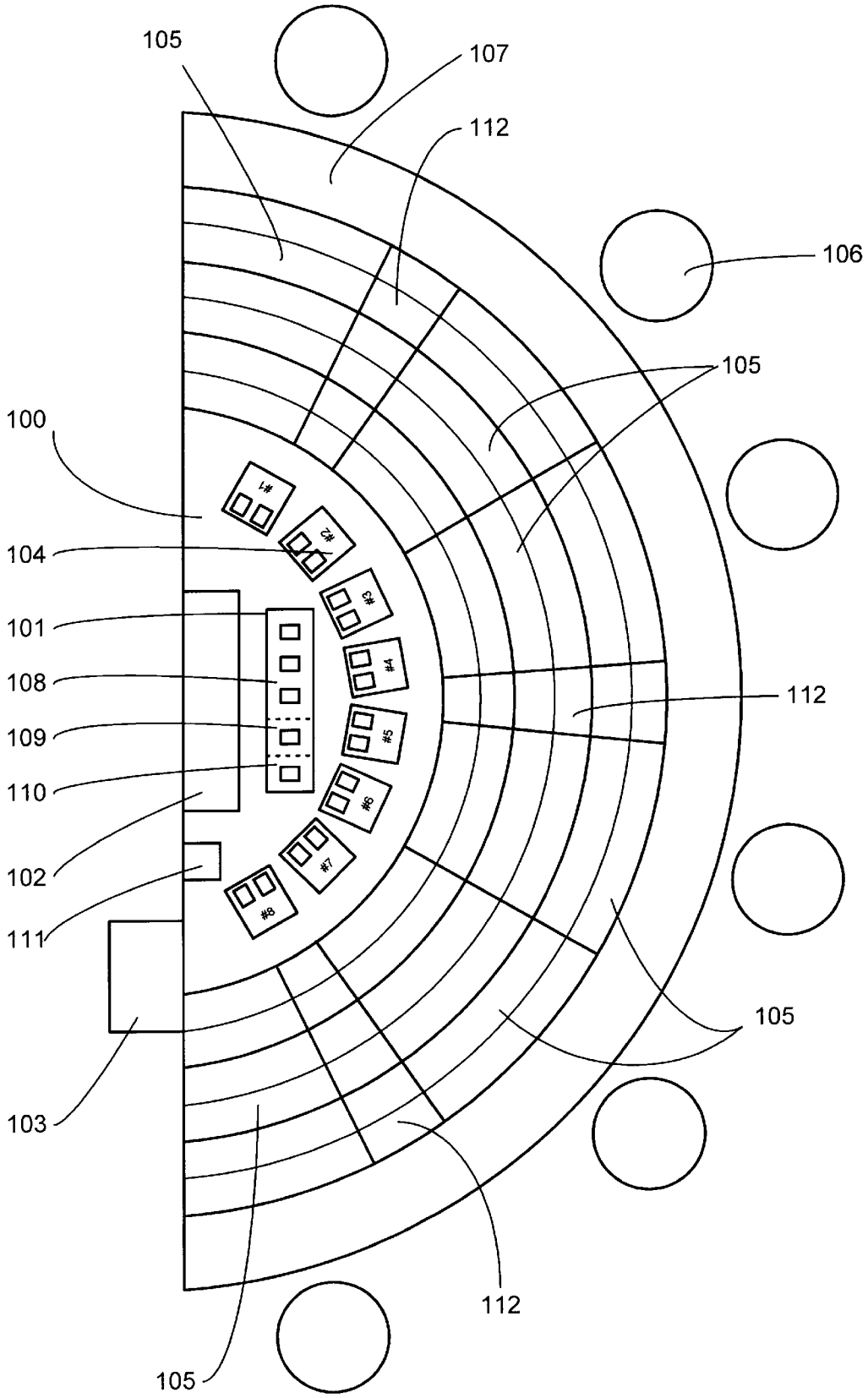
FIG. 1 is a plan view of a blackjack-type table layout with six player stations suitable for use with a preferred embodiment of the present invention.

Referring now to FIG. 1, a blackjack-type betting and seating arrangement is shown. The blackjack-type casino table 100 has a board area 101, a dealer chip area 102, an optional shuffle machine 103, a burn card area 111, eight separate card areas 104, six individual betting areas 105, three betting rules areas 112, six individual player locations 106, and a player chip area 107. The six player locations 106 are equally spaced about an arcuate peripheral edge of blackjack-type casino table 100. Player locations 106 will generally include chairs or stools, but they can be any sitting or standing arrangement with which people are most comfortable.

Each player location 106 lines up with one of betting areas 105 that are distributed about an internal arcuate edge of blackjack-type casino table 100. A single betting area 105 is shown in more detail in FIG. 2. A set of two betting areas 105 share a betting rules area 112. The three betting rules areas 112 and the eight separate card areas 104 are equally spaced about an internal arcuate edge of the blackjack-type casino table 100. A detailed view of a single betting-rules area is shown in FIG. 3. Each of the eight separate card areas 104 will have some markings corresponding to a particular hand. The markings could be numbers, letters, or colors (generally, the indicia will be the numbers one through eight), and will allow a player to distinguish one particular hand from another hand in the eight separate card areas 104. Having eight separate card areas allows each player to place bets on a card combination in the particular one of the separate card areas 104 that the player feels has the best chance of winning. A player may place wagers on any or all of the eight hands by placing chips or tokens on the appropriate individual betting area 105 in front of the player. It is important to note that the exact number of separate card playing areas 104, individual betting areas 105, betting rules areas 112, and individual player locations 106 can be varied as desired and as necessary to provide a comfortable type of gaming environment and thereby increase the level of betting activity for the casino. The number of betting categories and options can be increased or decreased to offer more options for the players, thereby maximizing the amount of money wagered each round.

Board area 101 has three sections: the flop area 108; the turn card area 109; and the river card area 110. Board area 101 consists of these sections to facilitate game play for at least one preferred embodiment of the present invention. Board area 101, however, can be enlarged or reduced to contain more or less cards, as desired. Board area 101 may also be rearranged to contain more, less, or no card turn areas, depending on the game being played.

In one preferred embodiment of the present invention, a dealer (not shown) deals two cards face-up to each separate card area 104. These cards may be dealt one-at-a-time in round robin fashion, or both cards together to a given card area 104. Five cards are dealt face-down to the board area 101. The dealer may choose to burn one or more cards to the burn card area 111. Normally, the dealer deals from one standard 52-card deck of cards, but more decks of cards, or special decks of cards (e.g., decks having wildcards), may be used. Each player seated or standing at player locations 106 then bets by placing betting chips or tokens in his or her individual betting area 105. After the dealer deals the eight hands and board cards, players will normally have twenty to thirty seconds to analyze the eight hands and to place their wagers. The dealer then turns the five cards face-up in the board area 101. Note that, in the preferred embodiment of the invention, none of the hands may fold. All hands are "live," and all hands remain live, irrespective of whether or not a bet is placed on a particular hand. Each set of cards in each separate card area 104 is used, along with the five common cards in board area 101, to comprise a seven card group. The dealer selects the best five cards from each group of seven cards to make the best five-card poker hand. In this embodiment, there are eight separate, complete poker hands, one for each of the separate card areas 104. Each of the eight hands is ranked according to the conventional poker-ranking methods described above.

The dealer then compares the rank of each of the eight hands and determines which hand (two or more may tie) is the highest. The dealer should call out the position of the winning hand and the rank of that highest hand (i.e.—"Hand number two wins with a flush"). If a bettor's wagers correspond to the position or rank of the winning hand, that bettor is declared a winner. If there are any winners, those winners are paid according to the odds associated with each of the winner's bets. All losing bets are collected. It is important to note that, given this betting scenario, some, all or none of the players may win their bets in a given round of play.

An important feature of the present invention is that the preferred embodiments of the game require only a single player. This player plays, essentially, against the house. Each player may bet on any hand on which he or she wishes to bet. This feature of the game makes the game much easier to play and holds the players' interest throughout each round of play.

Due to the multitude of different poker game variations that exist, the preferred embodiment described above is but one of many potential variations. For instance, more or less face-up or face-down cards may be dealt to each separate card area 104. More or less cards may be dealt to board area 101, and several dealings of cards to board area 101 may be necessary to complete the hands, with the cards being rolled one at time between multiple rounds of betting. The game may be played as 5 card hold 'em, 7 card hold 'em, etc. Also, players may be given the option to place additional bets at different stages of the game.

Using yet another poker variation as an example, the house might require players to place initial or "ante" bets before any cards are dealt. Two cards would then be dealt face-down to each separate card area 104. Players could bet again, and three common cards would then be dealt to board area 101. A final betting round would occur before the last two cards are dealt to the board area 101 (actually to turn card area 109 and river card area 110), and the winners, if any, are identified and paid. It is within the scope of the invention to complete each hand, by dealing enough cards to each hand to make appropriate poker hands, versus having the common cards complete the hands. Having common cards, however, reduces the total number of cards used per round and increases the likelihood of multiple winners. This, in turn, will most likely increase both the number of participants and the number of bets placed by the participants.

Referring still to FIG. 1, several betting accouterments are shown. Player chip area 107 is spacious enough to allow drinks, ashtrays, betting chips, etc., to be stored in a convenient manner for the gamblers. The optional shuffle machine 103 and the dealer chip area 102 are preferred additions, allowing quick and efficient play.

Figure 2:
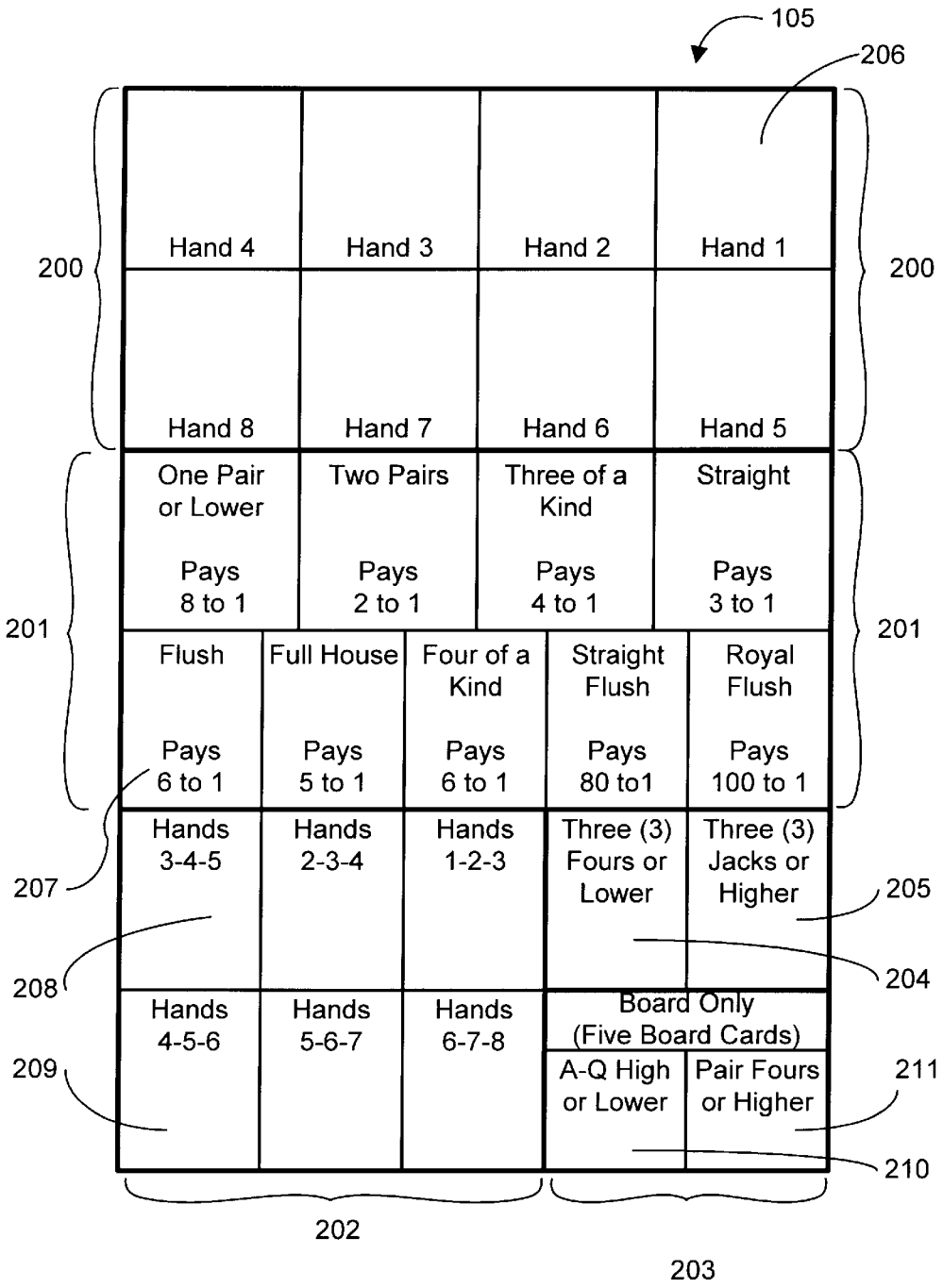
FIG. 2 is an enlarged plan view of an individual player betting area from FIG. 1.

Referring now to FIG. 2, one preferred embodiment of an individual betting area 105 is shown (not drawn to scale). In this embodiment, individual betting area 105 has four main betting categories: the position category 200; the winning-rank category 201; the position field category 202; and the rank field category 203. The categories are, themselves, made up of various individual betting options. For instance, rank field category 203 consists of option 204 (Three Fours or Lower bet), option 205 (Three Jacks or Higher bet), and two board-only bets, A-Q High or Lower bet 210 and Pair Fours or Higher bet 211. The latter, board-only, bets are drawn using only the five board cards.

For position category 200, each of the options represents the position of one of the hands that will be dealt. So, as shown in FIG. 1, if there are eight separate card areas 104, then there would be eight different options in position category 200. Option 206, representing Hand 1, is representative of the various betting options in position category 200. Each player could choose to place a bet in any or all of the various position categories 200. Winning-rank category 201 consists of betting options that correlate to the poker rank of the eventually winning hand. Option 207 (Flush) is indicative of the types of options in winning-rank category 201. Generally, One Pair or Lower, Two Pairs, Three of a Kind, Straight, Flush (option 207), Full House, Four of a Kind, Straight Flush, and Royal Flush will comprise the options in winning-rank category 201. However, poker ranks may be divided amongst themselves or grouped together to add or subtract betting options to the winning-rank category 201.

In another preferred embodiment of the present invention, the casinos may choose to designate one or more of the hands as "house hands," preluding players from wagering on those hands and thereby assuring the house edge or advantage. This designation of the house hands can take various forms, such as having the spin of a wheel select the hand, having one of the multiplicity of hands always be the house hand, or having the dealer, with each round, select one hand from the multiplicity of hands to be the house hand.

Finally, in the preferred embodiment (eight hands being dealt), six options in position field category 202 are directed to adjacent groups of three of the multiplicity of dealt hands located in separate card areas 104. As an example, option 208, representing the Hands 3-4-5, is an option where, if the winning hand based on poker rank is in any of the hands located in positions three, four, or five of separate card areas 104, then option 208, representing Hands 3-4-5, will be a winning option. Additionally, if the hand in position number four wins, then wagers on Hands 2-3-4 and Hands 4-5-6 will also win. In this way, the odds always favor the house (for hands one and eight, there is only one possible field bet per hand; for hands two and seven, there are two possible field bets per hand; and for hands three through six, there are three possible field bets per hand). Similarly, if the winning hand based on poker rank is found in the group of hands consisting of the hands located in positions four, five, or six of the separate card areas 104, then option 209, representing Hands 4-5-6, will be declared a winning option.

In the instance where more than one hand wins (two hands tie with the same poker rank), the winner who placed a wager on the field bet that encompasses the two winning hands still only wins the odds associated with that field bet. For instance, if a bettor places a one dollar field bet on Hands 3-4-5, both hands three and four have the same winning poker rank, and the odds for the field bets are one to one, then the bettor will win one dollar. The bettor will not win one dollar for hand three and one dollar for hand four. In other words, the odds for a field bet to win are the odds for one, two, or all three hands to win. While not preferred, casinos may alternatively decide to pay all winners.

As explained thus far, the preferred embodiments of the present invention allow a broad range of different types of bets. In position field category 202, for instance, the grouping of the hands for each option can easily be changed to suit the number of players or the chances of winning. Instead of having three hands per option, each option could have two or four hands per option, and the hands per option need not be contiguous (e.g.—the field bet including the hands located in positions 1-2-3 could alternatively be a field bet for hands located in positions 1-3-5).

As another example of the expansive betting formats that this invention affords, the options within rank field category 203 could be expanded to include a third option comprising the remaining poker ranks not included in the existing options (namely hands having three fives, sixes, sevens, eights, nines, or tens). Rank field category 203 thusly gives casinos the flexibility to add exciting variations to the game.

In the preferred embodiment, each betting category will have some odds assigned to each of the individual options within that betting category. For example, option 207, representing the Flush of winning-rank category 201, pays six to one odds. The odds for each betting option will generally correlate to the odds of achieving a certain poker rank, given the number of hands dealt and the number of cards dealt to each hand and the board area. Also to be factored in is the number of decks of cards used and whether or not the decks of cards being used are standard or non-standard (i.e., whether or not Jokers or wild cards are being used). The odds given in our figures are examples only, and casinos will of course have the final right to set the odds as they deem fit.

Referring now to FIG. 3, a betting rules area 112 is shown. Betting rules area 112 consists of the general rules area 320, the position rules area 321, the winning-rank betting rules area 322, and the even money betting rules area 323. Position rules area 321 lines up with position category 200; winning-rank betting rules area 322 lines up with winning-rank category 201; and even money betting rules area 323 lines up with both position field category 202 and rank field category 203. Each of the respective rules areas contains important rules as to how the game is run. For instance, general rules area 320 contains rules relating to the overall game, and position rules area 321 explains rules concerning the position bets.

The even money betting rules area 323 contains the odds associated with each option of position field category 202 and rank field category 203. These odds are one to one. With regard to position category 200, the odds for any winning hand correspond to the probability of obtaining the poker rank for that winning hand. These odds are listed in position rules area 321. As an example, if the winning rank and hand are a flush in hand number one, then any bettor who placed a bet in Option 206, representing Hand 1, will win at three to one odds. Ties between one or more hands, wherein two or more (four maximum) hands each have the same poker rank, generally decrease the payoff by one-half (no matter if two, three, or four hands tie). So, if three hands have one pair or lower, and the odds for one pair or lower are four to one, each winning player will get a two to one payoff.

Figure 4:
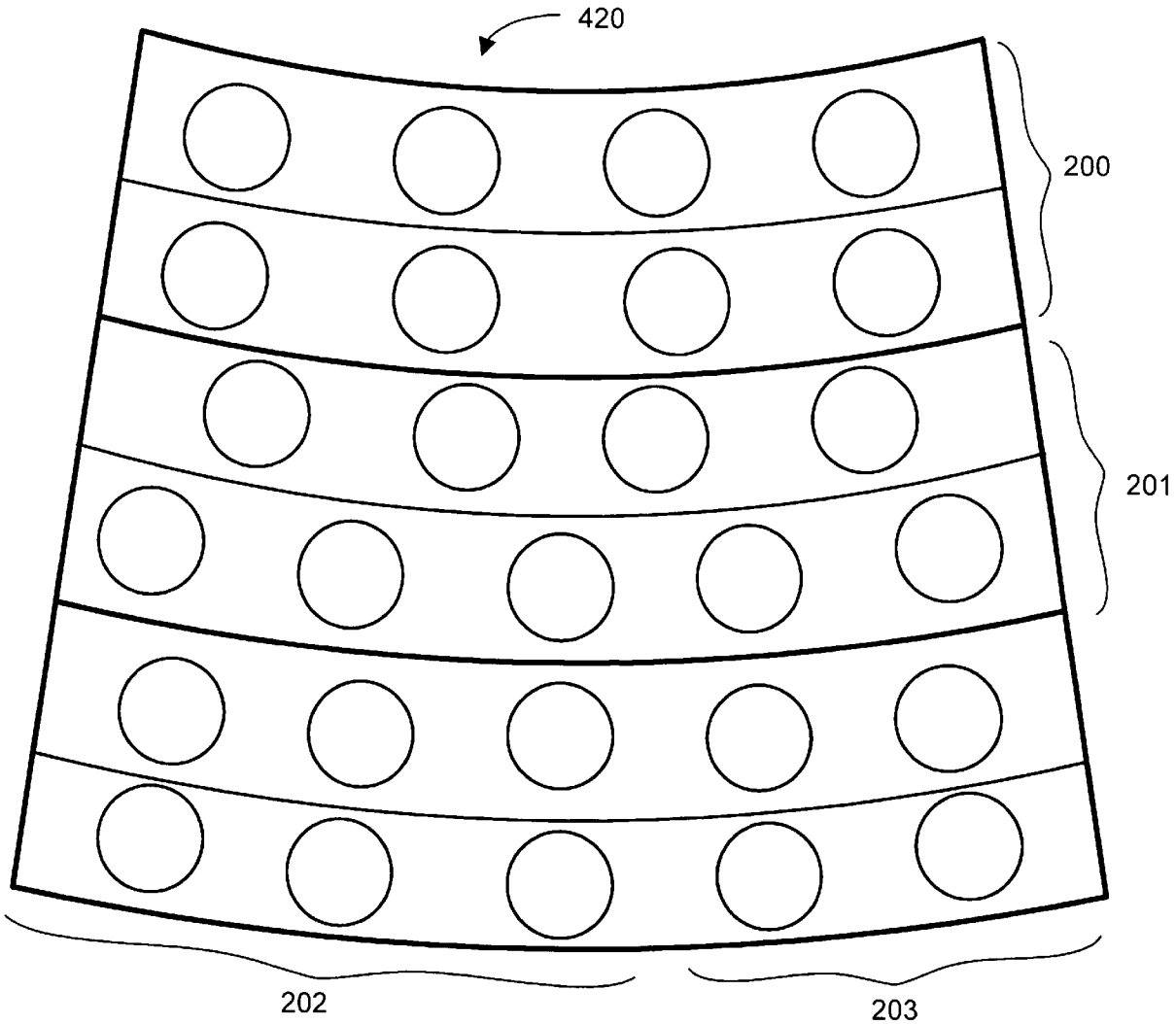
FIG. 4 is an enlarged plan view of another individual player betting area, suitable for use with a different embodiment of the invention, from FIG. 1.

Turning now to FIG. 4, another embodiment of an individual betting area 420 is shown. Individual betting area 420 has the same categories as individual betting area 105 (e.g.—the position category 200, the winning-rank category 201, the position field category 202, and the rank field category 203). The options for each category are, however, placed within circles in order to make it easier to see where bets have been placed.

Figure 5:
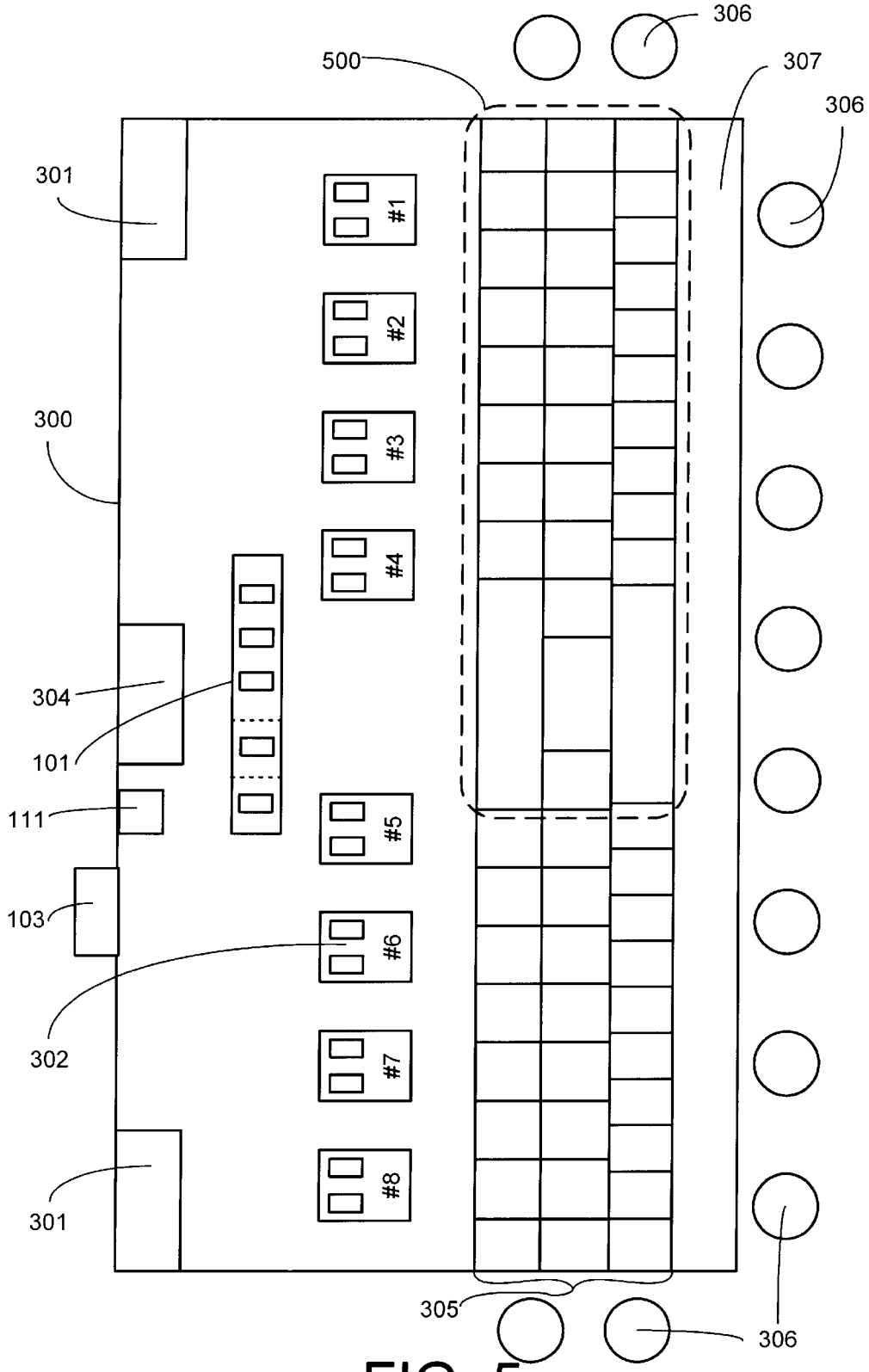
FIG. 5 is a plan view of a craps-type table layout with twelve player stations suitable for use with a preferred embodiment of the present invention.
Figure 7:
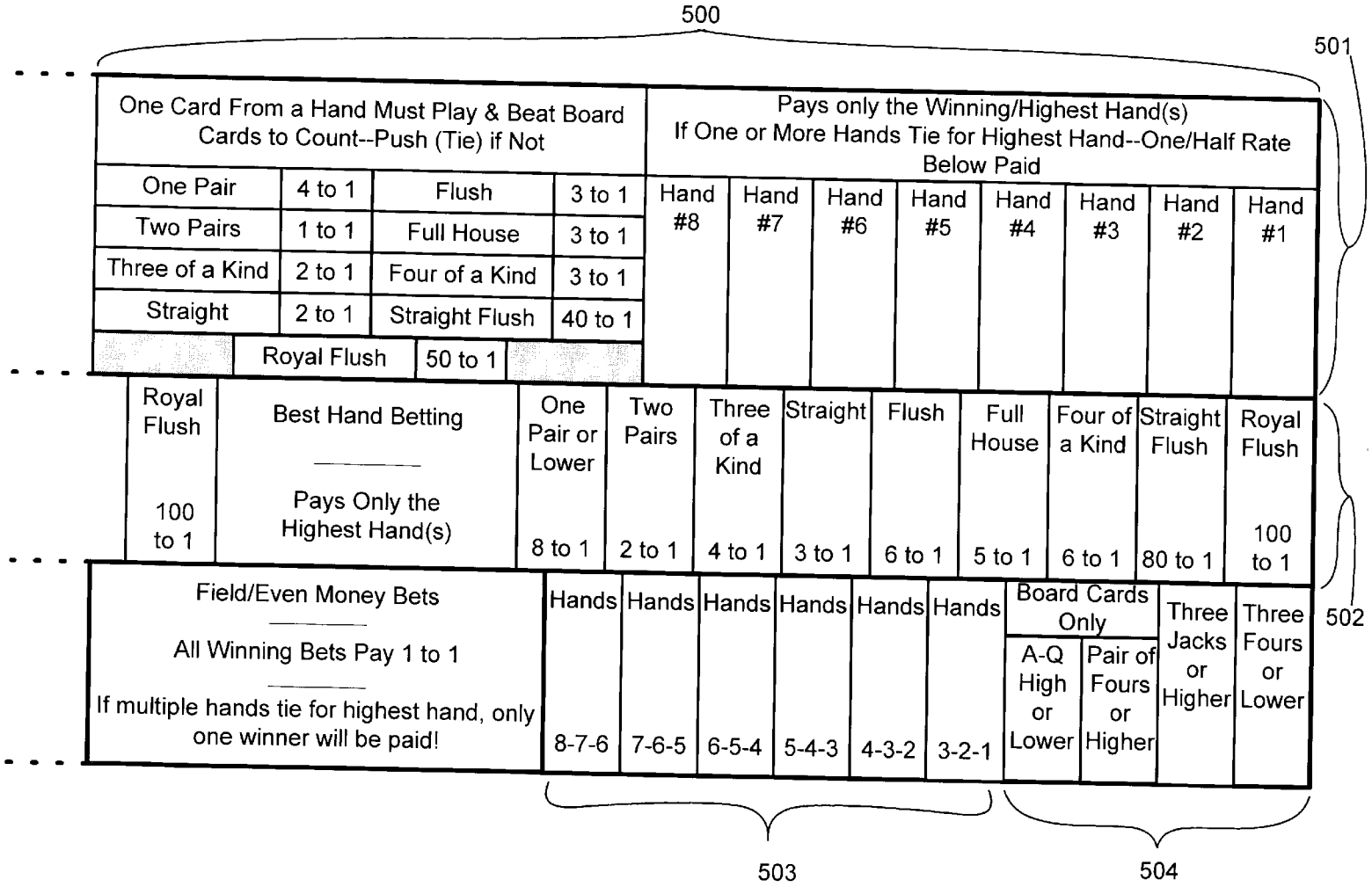
FIG. 7 is an enlarged plan view of a group player betting area for a craps-type or roulette-type table layout.

Referring now to FIG. 5, a craps-type casino table 300 with an alternative betting and seating arrangement is shown. Craps-type casino table 300 has two low denomination chip areas 301, a high denomination chip area 304, a board area 101, eight individual card areas 302, a chip rack area 307, a table betting area 305, an optional shuffle machine 103, and a burn card area 111. Parallel and adjacent to three edges of the craps-type casino table 300 are twelve individual player positions 306. Different denominations of chips may be stored in low denomination chips area 301 and high denomination chips area 304. Each individual card area 302 will have an appropriate marking (preferably numbered one through eight) that allows each of the individual card areas 302 to be assigned to one of the eight hands. Table betting area 305 consists, basically, of two mirror-image player betting areas 500, a right and left betting area. Player betting area 500 is reproduced in greater detail in FIG. 7. The rules and odds are conveniently located in the center of table betting area 305 (and are also depicted in FIG. 7). Players who are sitting or standing on the right-hand side of the table will use the right-hand player betting area (player betting area 500). If a player cannot reach far enough to place his or her bets, the player need only call out to the dealer who can then place the player's bets.

There are several additional variations that will help game play proceed smoothly. For example, the individual card areas 302 may be arrayed along a curved line (instead of being linearly arrayed, as shown in FIG. 1) to help the dealer more easily deal and pickup cards from individual card areas 302. A "boxman," who does no dealing, would oversee the entire table. Other variations can be added as a casino needs them.

Figure 6:
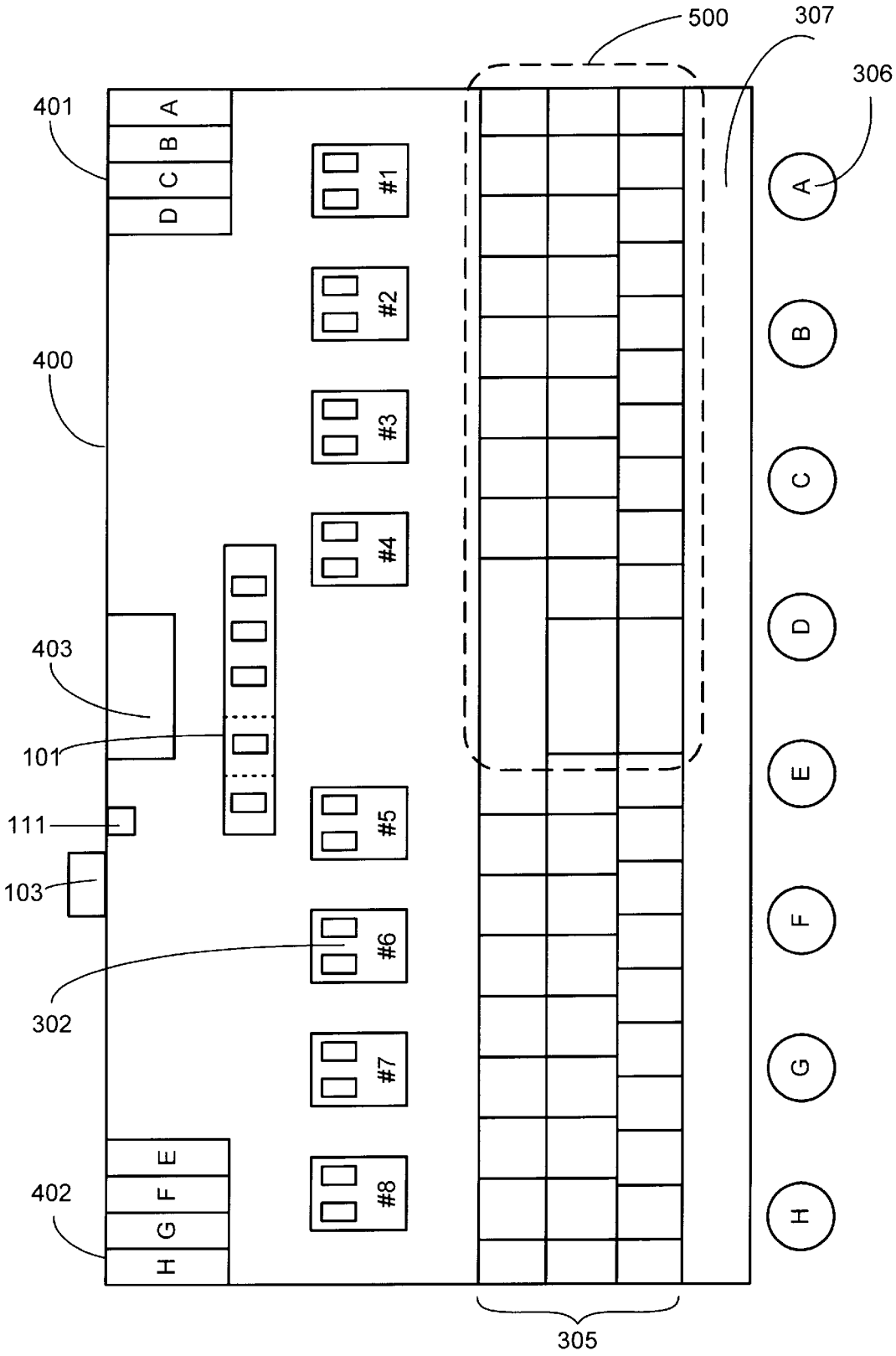
FIG. 6 is a plan view of a roulette-type table layout with eight player stations suitable for use with a preferred embodiment of the present invention.

Referring now to FIG. 6, a roulette-type casino table 400 with an alternative betting and seating arrangement is shown. Roulette-type casino table 400 has a first colored chips area 401, a second colored chips area 402, a board area 101, eight individual card areas 302, a chip rack area 307, an optional shuffle machine 103, a burn card area 111, and a table betting area 305. Parallel and adjacent to one edge of roulette-type casino table 400 is a row of individual player positions 306. Ideally, four colors of chips will be stored in the first colored chips area 401, and four more colors of chips will be stored in the second colored chips area 402. The variety of different colors allows each player to have uniquely colored chips, making it much easier to identify and follow each player's betting. In FIG. 6, first colored chips area 401 has four letters, "A" through "D," that correspond to letters indicated on four individual player positions 306 (similarly, second colored chips area 401 has four letters, "E" through "H," that correspond to letters indicated on four individual player positions 306). Each letter corresponds to a different color. These letters merely denote that there are eight different colored chips for the eight individual player positions 306. Even though the board layouts between craps-type casino table 300 and roulette-type casino table 400 are very similar, the tables and seating arrangements may look quite different.

Referring now to FIG. 7, a preferred embodiment of a player betting area 500 suitable for use with craps-type casino table 300 and roulette-type casino table 400 is shown. Similar to previously discussed individual player betting area 105, player betting area 500 in this embodiment of the present invention has four betting categories: the position category 501; the winning-rank category 502; the position field category 503; and the rank field category 504. The categories are, themselves, made up of various individual betting options. The various options within the different categories are as explained above in relation to FIG. 2. This layout is preferred for craps-type casino table 300 and roulette-type casino table 400 for accommodating a larger number of players. However, it should be noted that the exact placement of the various categories and betting options within the various categories can be arranged as desired to best achieve the desired game play.

While the previous description provided above is based on actual "live" table play, an alternative preferred embodiment of the present invention can be implemented in an electronic or computer simulation. A number of individual hands can be simulated, electronic representations of the cards dealt to those hands, electronic bets can be placed, common cards can then be dealt to the board area, and the winners chosen according to the various criteria and playing options described above. The electronic version of the game can include any number of simultaneous players (particularly if simulcast or Internet play is developed). Further, having a large number of players might allow additional gaming options such as progressive, intermediate, and jumbo cumulative jackpots.

Figure 8:
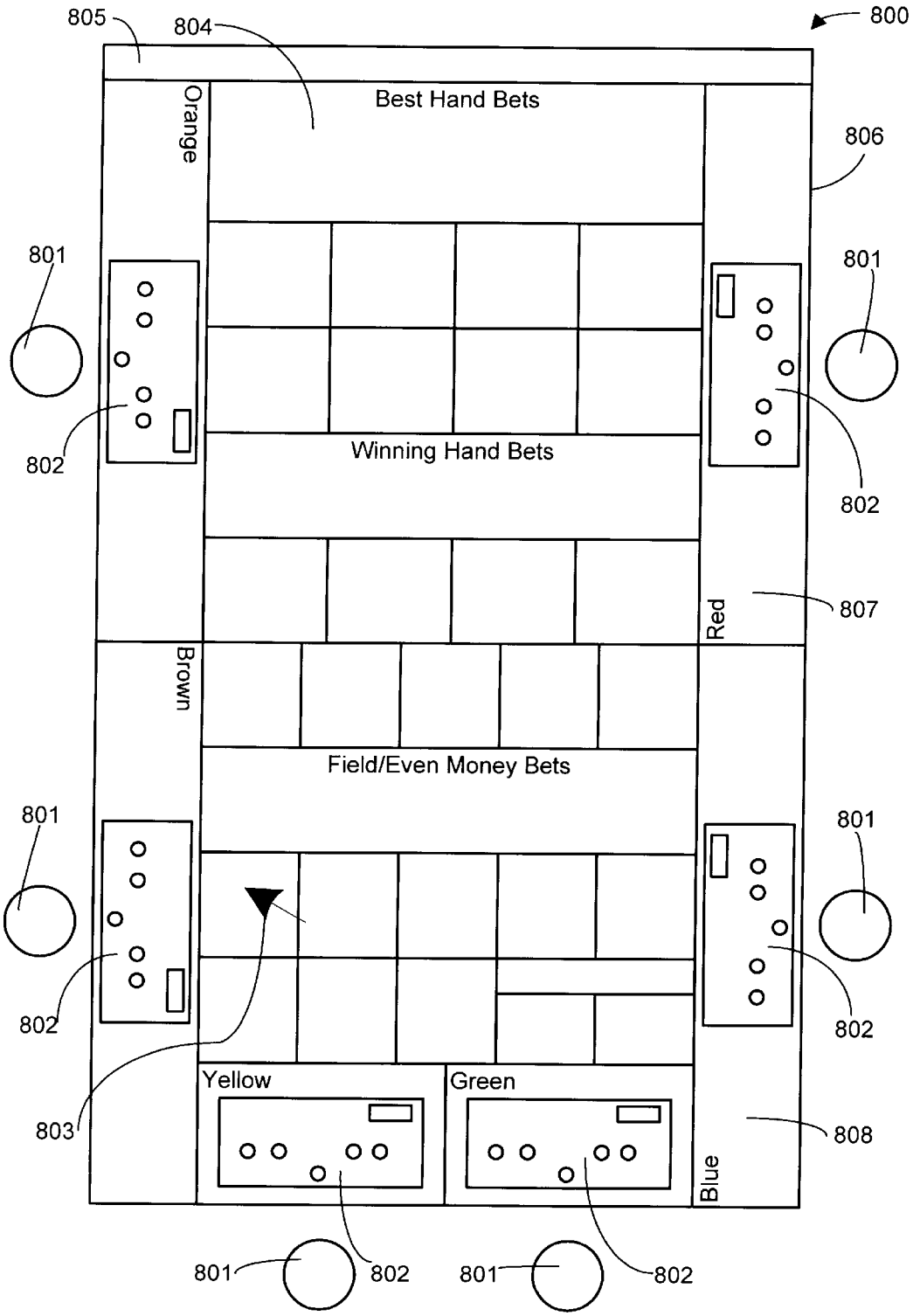
FIG. 8 is a perspective view of an electronic or computer-based implementation of a preferred embodiment of the present invention.

Turning now to a preferred electronic embodiment of the game, shown in FIG. 8, electronic game 800 is depicted. Electronic game 800 consists of a top display 806 and a back display 805. Top display 806 of the electronic game 800 consists of six individual betting controls 802 and a betting area 804. Six player locations 801 are dispersed about the periphery of electronic game 800. Betting area 804 has all of the features of player betting area 500, including all necessary rules. Each player, by using an individual betting control 802, can control a colored cursor 803. There is one colored cursor 803 for each of the 6 individual betting controls, meaning that there will be six different colored cursors in betting area 804 at all times (regardless of how many people are playing the game). In FIG. 8, colored cursor 803 is shown over an option in the field or even money betting area. There is only one colored cursor shown in FIG. 8. FIG. 8 shows the outer periphery of top display 806 of electronic game 800 being split into colored sections to more easily show which player has which colors. For example, the top of colored player area 807 is the red area, while the top of colored player area 808 is the blue area.

Figure 9:
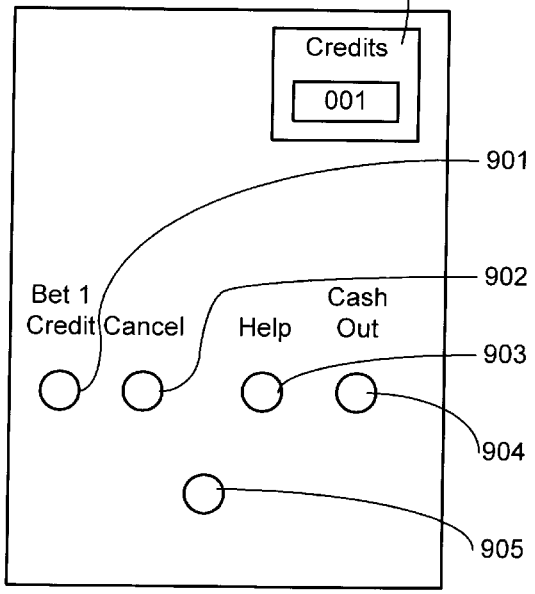
FIG. 9 is an enlarged perspective view of an individual player betting area from FIG. 8.

An individual betting control 802 is shown in more detail in FIG. 9. Individual betting control 802 is comprised of a credits box 900, a bet one credit button 901, a cancel button 902, a help button 903, a cash out button 904, and a track ball 905.

Figure 10:
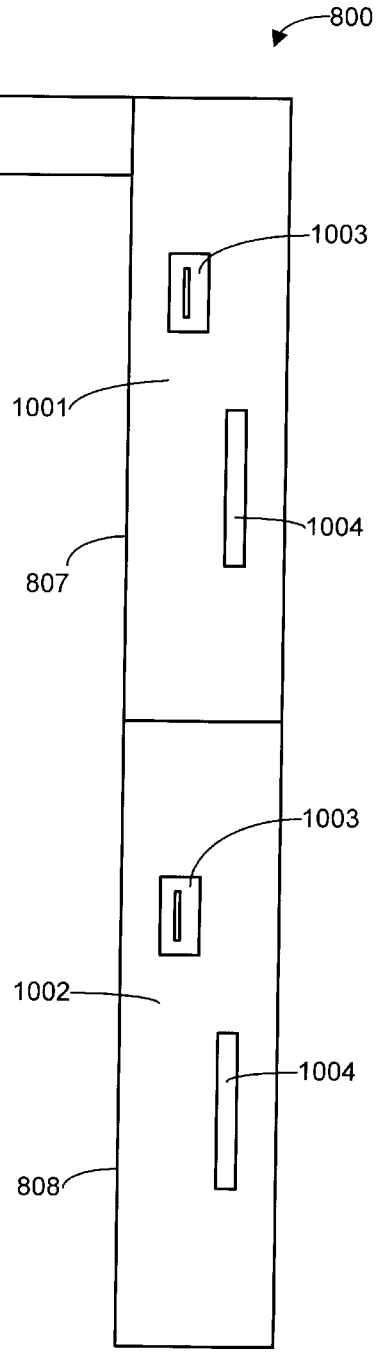
FIG. 10 is a side view of an electronic-based implementation of a preferred embodiment of the present invention.

A side view of the electronic game 800 is depicted in FIG. 10. The back display 805 has a front screen 1000. Front screen 1000 shows the eight separate card areas 302, the board area 101, the electronic equivalent of cards, and other necessary information to enable players to adequately play the game (front screen 1000 will not be shown in a figure). Colored player area 807 has a side 1001, and colored player area 808 has a side 1002. Each colored player area's side includes a bill acceptor 1003 and a coin return 1004.

A player places one or more bills in bill acceptor 1003 and is shown the number of credits corresponding to this amount on the credit box 900. The player can position her colored cursor 803 over the option on which she wishes to bet. Then, she presses the bet one credit button 901 once for each credit she wishes to bet on that option. Should she desire to bet five credits, she must press the bet one credit button 901 five times. The number of credits that she has bet on each option will generally be shown on the option, either with colored chips or through colored numbers. The use of colored chips or numbers clearly separates each player's bet. Thus, all six players could bet on the same option, and each player will know how much he/she bet on that option. A bettor can continue selecting different options, betting a like amount or a different amount on each option. Should the player wish to cancel, she can either hit the cancel button 902 (to cancel the current operation) or the cash out button 904 (to get her money and quit the game). The help button 903 is available to summon attendants (or a help menu). The players will have a certain amount of time to place bets; the time will be indicated on the front screen (neither the timer nor the front screen is shown).

Although the prior figures adequately point out the improvements over the prior art that this invention makes, the following table should be of more use in this regard.

| Traditional Texas Hold 'Em | Present Invention |
|---|---|
| Rules stipulate that each player may only participate with the specific and unique cards that are dealt them. | The player may place wagers on any of the multitude of hands dealt. |
| In all cases, the number of different hands dealt corresponds directly and exactly to the number of players (five hands to five players). | The number of hands dealt is constant (eight in the preferred embodiment). |
| Wagers made by the players throughout the game are accumulated in "the pot" and the amount won by the highest hand is limited to the sum of all those wagers (less house rake). | Each specific wager has variable odds associated with it and players may place up to 27 different wagers (in the preferred embodiment) on each round of play. |
| Due to various circumstances (bets, raises, etc.), frequently all but one or two (of up to ten players) may fold their cards and as a result cannot win the pot. | All of the constant number of hands remain live and thereby hold the potential of being the highest hand. |
| Players only see the two cards that are dealt to them. | Players can see all eight of the two-card hands (sixteen total cards). |
| Almost all Hold 'Em games require a minimum of six players with eight to ten players needed for the best play and most betting. | As few as one player can play the game against the house. |
| Players are able to (in fact must) touch cards. | Dealer is the only person to come in contact with the playing cards (making it impossible for the players to cheat). |

While the invention has been particularly shown and described with reference to preferred embodiments thereof, it will be understood by those skilled in the art that various changes in form and details may be made therein without departing from the spirit and scope of the invention.

I claim:

1. A method of playing a card game, the method comprising the steps of:

providing a first betting category having a plurality of options;

providing a second betting category having a plurality of options;

dealing a predetermined like number of initial cards to a plurality of separate hands, at least one of the initial cards for each of the plurality of separate hands being dealt face-up;

dealing a predetermined number of communal cards;

at least one player placing a wager on at least one selected option from at least one betting category;

turning all of the communal cards and all of the initial cards face up; and comparing each of the separate hands, in conjunction with the communal cards, to each option in each betting category to determine at least one winning option.

2. The method of claim 1 wherein the step of providing a first betting category having a plurality of options comprises the step of providing a plurality of options which correspond to one of the plurality of separate hands; and wherein the step of providing a second betting category having a plurality of options comprises the step of providing options which correspond to a poker rank.

3. The method of claim 1 wherein the step of dealing a predetermined like number of initial cards to a plurality of separate hands comprises the step of using at least one standard deck of 52 playing cards to deal the plurality of separate hands.

4. The method of claim 1 wherein the step of dealing a predetermined number of communal cards comprises the step of dealing 5 cards to a board area.

5. The method of claim 1 wherein the predetermined like number of initial cards is two, both cards being dealt face-up; and wherein the predetermined number of communal cards is five.

6. The method of claim 1 further comprising the steps of:

comparing the at least one player's selected option of the at least one betting category against the at least one winning option and declaring the at least one player a winner if the at least one player's selection is the winning option; and paying the at least one player a predetermined amount if the at least one player has been declared a winner.

7. The method of claim 6 further comprising the steps of:

providing predetermined betting odds for each option within each betting category; and wherein the predetermined amount is determined by using the predetermined betting odds provided for the at least one winning option.

8. The method of claim 5 wherein the number of separate hands is eight.

9. The method of claim 1 wherein the step of dealing a predetermined like number of initial cards to a plurality of separate hands comprises the step of using at least one standard deck of 52 playing cards to deal the plurality of separate hands.

10. The method of claim 9 wherein the step of using at least one standard deck of 52 playing cards to deal the plurality of separate hands further comprises the step of using at least one wildcard.

11. The method of claim 1 wherein the step of dealing a predetermined number of communal cards comprises initially dealing three cards face-up and two cards face-down.

12. The method of claim 11 wherein the plurality of separate hands comprises at least four hands; and wherein the step of providing a third betting category comprises the step of providing a plurality of options which correspond to a set of three hands from the plurality of separate hands, with no two options including the same three hands.

13. The method of claim 12 wherein:

the plurality of separate hands comprises at least four hands;

wherein the step of providing a third betting category comprises the step of providing a plurality of options which corresponds to a set of three hands from the plurality of separate hands, with no two options including the same three hands; and wherein the step of providing a fourth betting category having a plurality of options comprises the step of providing a plurality of options which correspond, respectively, to hands containing cards comprising Three Fours or Lower, Three Jacks or Higher, Ace-Queen High or Lower, and a Pair of Fours or Lower.

14. The method of claim 1 further comprising the step of providing a third betting category, the third betting category having a plurality of options.

15. The method of claim 1 further comprising the step of providing a fourth betting category having a plurality of options.

16. The method of claim 15 wherein the step of providing a fourth betting category having a plurality of options comprises the step of providing exactly four options which correspond to, respectively, a hand containing cards comprising Three Fours or Lower, a hand containing cards comprising Three Jacks or Higher, a hand containing cards comprising Ace-Queen High or Lower, and a hand containing cards comprising Pair Fours or Lower.

17. The method of claim 1 further comprising the steps of:

turning one of the two face-down communal cards face-up; and providing the opportunity for at least one player to select and wager on at least one option from at least one betting category prior to exposing the other face-down communal card.

18. The method of claim 1 further comprising the step of designating at least one of the plurality of hands as house hands, thereby preventing the at least one player from placing any wager on any option which would designate the at least one house hand as a potential winning option.

19. A method of playing a poker card game using a standard 52 card playing deck, the method comprising the steps of:

providing a first betting category having a plurality of options;

providing a second betting category having a plurality of options;

providing a third betting category having a plurality of options;

dealing a predetermined like number of initial cards to 8 separate hands, at least one of the initial cards for each of the 8 separate hands being dealt face-up;

dealing 5 communal cards to a board area, wherein two of the 5 cards are dealt face up;

at least one player selecting and wagering on at least one option from at least one betting category;

turning all cards initially dealt face down face up; and comparing each of the separate hands, in conjunction with the communal cards, to each option in each betting category to determine at least one winning option.

20. The method of claim 19 wherein the step of providing a first betting category having a plurality of options comprises the steps of providing a plurality of options which correspond to one of the plurality of separate hands and wherein the step of providing a second betting category having a plurality of options comprises the step of providing options which correspond to a given poker rank and wherein the step of providing a third betting category comprises the step of providing a plurality of options which corresponds to a set of three hands from the plurality of separate hands, with no two of the plurality of options including the same three hands.

21. The method of claim 19 further comprising the step of providing a fourth betting category, the fourth category having a plurality of options.

22. The method of claim 21 wherein the step of providing a fourth betting category comprises the step of providing a plurality of options which correspond to, respectively, to a hand containing cards comprising Three Fours or Lower, to a hand containing cards comprising Three Jacks or Higher, to a hand containing cards comprising Ace-Queen High or Lower, and to a hand containing cards comprising a Pair of Fours or Lower.

23. The method of claim 19 further comprising the steps of:

comparing the at least one player's wager against the at least one winning option and declaring the at least one player a winner if the at least one player's wager is the winning option; and paying the at least one player a predetermined amount if the at least one player has been declared a winner.

24. The method of claim 23 further comprising the steps of:

providing predetermined betting odds for each option within each betting category; and determining the predetermined amount from the predetermined betting odds provided for the at least one winning option.

25. The method of claim 23 further comprising the step of designating one or more of the plurality of hands as house hands, thereby preventing the at least one player from placing any wager on any option which would designate the at least one house hand as a potential winning option.

26. A method of playing a poker card game using a standard 52 card playing deck, the method comprising the steps of:

dealing two face-up initial cards to eight separate hands;

providing a first betting category having eight options, each option corresponding to one of the eight separate hands;

providing a second betting category having nine options, each option corresponding to a poker rank;

providing a third betting category having six options, each option corresponding to a set of three hands from the eight hands, with no two options including the same three hands;

providing a fourth betting category having four options, the four options corresponding to poker hands containing, respectively, Three Fours or Lower, Three Jacks or Higher, Ace-Queen High or Lower, and Pair Fours or Lower;

providing predetermined odds for each option in each betting category;

dealing five face-down communal cards to a board area;

at least one player placing at least one wager on at least one option from at least one betting category;

turning all cards initially dealt face down face up;

comparing each of the separate hands, in conjunction with the communal cards, to each option in each betting category to determine at least one winning option;

comparing the at least one player's wager against the at least one winning option to declare the at least one player a winner if the at least one player's selection is the winning option; and paying the at least one player a predetermined amount, based on the odds for the winning option, if the at least one player has been declared a winner.

27. An apparatus for playing a card game in which at least one player plays the card game, the apparatus comprising:

at least one standard deck of poker playing cards;

a playing surface with a first and second betting category;

a plurality of wagering options being represented by plurality of separate locations within each of the first and second betting categories;

a predetermined number of positions for the display of a plurality of cards grouped into a plurality of hands;

wherein the plurality of wagering options in the first betting category correspond to one of each of the positions for the display of a plurality of cards grouped into a plurality of hands;

wherein the plurality of wagering options in the second betting category each correspond to a hand containing the appropriate combination of cards to create various poker ranks, no two wagering options corresponding to the same poker rank;

a predetermined position for the display of a plurality of communal cards; and at least one marker for indicating a selection of at least one option from at least one betting category.

28. An electronic apparatus for playing a card game in which at least one player plays the card game against a computer, the apparatus comprising:

a mechanism for simulating at least one deck of playing cards;

a mechanism for dealing and displaying an initial number of cards to each of a plurality of hands;

a mechanism for indicating at least a first and a second betting category, wherein the first and second betting categories each contain at least one wagering option;

wherein the plurality of wagering options in the first betting category correspond to one of the plurality of hands;

wherein the plurality of wagering options in the second betting category each correspond to a hand containing the appropriate combination of cards to create various poker ranks, no two wagering options corresponding to the same poker rank;

a mechanism for indicating the at least one player's selection and wager placed on at least one option from the first or second betting categories;

a mechanism for simulating the dealing and displaying an additional number of communal cards; and a mechanism for determining whether the at least one player wins or loses.

* * * * *